US005615693A

United States Patent [19]

Saitoh

[11] Patent Number: 5,615,693

[45] Date of Patent: Apr. 1, 1997

[54] CIGARETTE ROD MANUFACTURING APPARATUS

[75] Inventor: Masayoshi Saitoh, Tokyo, Japan

[73] Assignee: Japan Tobacco Inc., Tokyo, Japan

[21] Appl. No.: 598,914

[22] Filed: Feb. 9, 1996

[30] Foreign Application Priority Data

Feb. 9, 1995 [JP] Japan ..... 7-022089

[51] Int. Cl.[6] ..... A24C 5/18

[52] U.S. Cl. ..... 131/84.1; 131/84.2; 131/84.3; 131/84.4

[58] Field of Search ..... 131/84.1, 84.2, 131/84.3, 84.4; 493/44

[56] References Cited

U.S. PATENT DOCUMENTS 3,716,443 2/1973 Marritt et al. ..... 131/84.1
5,163,452 11/1992 Preston ..... 131/84.1
5,520,195 5/1996 Rizzoli et al. ..... 131/94

FOREIGN PATENT DOCUMENTS 2245145 4/1975 France ..... 131/84.1
2108819 5/1983 United Kingdom ..... 131/84.1

*Primary Examiner*—V. Millin
*Assistant Examiner*—Charles W. Anderson
*Attorney, Agent, or Firm*—Birch, Stewart, Kolasch & Birch, LLP

[57] ABSTRACT

A cigarette rod manufacturing apparatus includes a shaping section for continuously forming a cigarette rod from a paper and cut tobacco, by using an endless fibrous garniture tape traveling in one direction. Two spray nozzles are located outside the shaping section which are used to spray a wetting liquid on the inner and outer surfaces of the garniture tape, individually.

10 Claims, 2 Drawing Sheets

CIGARETTE ROD MANUFACTURING APPARATUS

BACKGROUND OF THE INVENTION

1. Field of the Invention

The present invention relates to an apparatus for manufacturing a cigarette rod as an intermediate product for cigarettes, and more specifically, to a cigarette rod manufacturing apparatus which uses a garniture tape to form the cigarette rod.

2. Description of the Related Art

A cigarette rod manufacturing apparatus comprises a feeder for feeding cut tobacco onto paper which travels in one direction. The paper, thus supplied with the cut tobacco, passes through a shaping tool which is located on the downstream side of the feeder. In this process of passage, the cut tobacco is wrapped in the paper, whereupon a cigarette rod, a continuous semi-finished product for cigarettes, is completed.

As the cigarette rod is manufactured, the paper, having received the cut tobacco, passes through the shaping tool at high speed. Since the paper is soft and liable to tear, it is hard to run the paper by pushing or pulling it and to wrap the cut tobacco in the paper by directly bending the paper itself by means of the shaping tool. An endless fibrous garniture tape is used so that the paper can travel and wrap the cut tobacco therein. The paper is superposed on the garniture tape, and is run together with the tape at a high speed by utilizing a frictional force between them. As the paper, along with the garniture tape, passes through the shaping tool, therefore, it is bent by the shaping tool with the aid of the garniture tape. Thus, the cut tobacco can be wrapped in the paper with stability, and the cylindrical cigarette rod is formed continuously.

That region of the rapidly traveling garniture tape which is in contact with the shaping tool is heated by frictional heat. If the temperature of the garniture tape rises in this manner, moisture in the garniture tape evaporates so that the tape is dried. Thus, the garniture tape deteriorates and becomes liable to snap. If the frequency of snapping of the garniture tape increases, the operation of the cigarette rod manufacturing apparatus is stopped frequently, so that the operating efficiency of the apparatus is lowered.

Recently, the brands of cigarette rods to be manufactured have been changed very often with an increase in cigarette consumption and diversification of consumers' tastes. To cope with this, the cigarette rod manufacturing apparatus is expected to have a greater production capacity. Correspondingly, the traveling speed of the garniture tape is further increased.

If the feed of the garniture tape is additionally speeded up, the frictional heat generated as the tape passes through the shaping tool becomes very intense, so that the temperature of the tape further increases. Accordingly, the garniture tape dries more easily, so that its deterioration is hastened. If the garniture tape is too dry, a sufficient frictional force cannot be produced between the tape and the paper, so that the paper may possibly slip on the tape. In this case, the garniture tape cannot run the paper with stability, so that the formation of the cigarette rod is unstable.

SUMMARY OF THE INVENTION

The object of the present invention is to provide a cigarette rod manufacturing apparatus designed so that the deterioration of a garniture tape and the lowering of the quality of a cigarette rod can be restrained even though the traveling speed of the garniture tape is increased to cope with the build-up of the production capacity for the cigarette rod.

The above object is achieved by a cigarette rod manufacturing apparatus according to the present invention, which comprises: a shaping section for continuously forming a cigarette rod in a manner such that cut tobacco fed onto a paper is wrapped in the paper as the paper travels, the shaping section including an endless garniture tape for running the paper and a shaping tool for forming the paper and the cut tobacco into the cigarette rod in cooperation with the garniture tape, the shaping tool having an inlet and an outlet for the garniture tape; and humidifying means for humidifying the garniture tape.

According to the cigarette rod manufacturing apparatus described above, the garniture tape is humidified by using humidifying means. Thus, frictional heat, which is generated by friction between the garniture tape and the shaping tool and received by the tape, is satisfactorily cooled when water for the humidification evaporates. Accordingly, a rise in temperature of the garniture tape, as well as its drying, can be restrained, so that deterioration of the tape can be retarded suitably. Moreover, slipping of the garniture tape on the paper, which is attributable to the dry state of the tape, can be prevented, and the quality of the garniture tape can be stabilized.

Preferably, the garniture tape is formed of a fibrous material having hygroscopicity, and sufficiently absorbs moisture.

The humidifying means preferably includes a spray device for atomizing a wetting liquid by jetting air and spraying the atomized liquid on the garniture tape. In this case, the atomized wetting liquid is uniformly sprayed on the garniture tape, so that the tape is cooled fully. At the same time, the garniture tape is also cooled satisfactorily by jetted air.

The humidifying means preferably further includes adjusting means for adjusting the spray rate of the wetting liquid from the spray device. In this case, the rate of feed of the wetting liquid to the garniture tape is adjusted to an optimum value by using the adjusting means.

Preferably, moreover, the spray device is located outside the shaping section, and the humidifying means includes first and second spray devices located individually in the vicinity of the path of travel of the garniture tape and spaced thereform. Preferably, in this case, the first spray device is located on the outlet side of the shaping tool of the shaping section so that it can spray the atomized wetting liquid on the outer surface of the garniture tape to be brought into contact with the paper, while the second spray device is located on the inlet side of the shaping tool so that it can spray the atomized wetting liquid on the inner surface of the garniture tape. In this case, a surplus part of the wetting liquid sprayed on the outer surface of the garniture tape by the first spray device scatters in all directions before the tape starts to come into contact with the paper, so that the paper cannot be excessively wetted by the wetting liquid and torn. On the other hand, the lubrication between the inner surface of the garniture tape and the shaping tool is improved by the wetting liquid sprayed on the inner surface of the tape by the second spray device, so that production of frictional heat can be restrained satisfactorily.

Preferably, furthermore, the humidifying means includes means for recovering that surplus part of the wetting liquid from the first and second spray devices which is not absorbed by the garniture tape. In this case, the wetting liquid is prevented from splashing on surrounding equipment, and the recovered wetting liquid can be recycled.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENT

Figure 1:
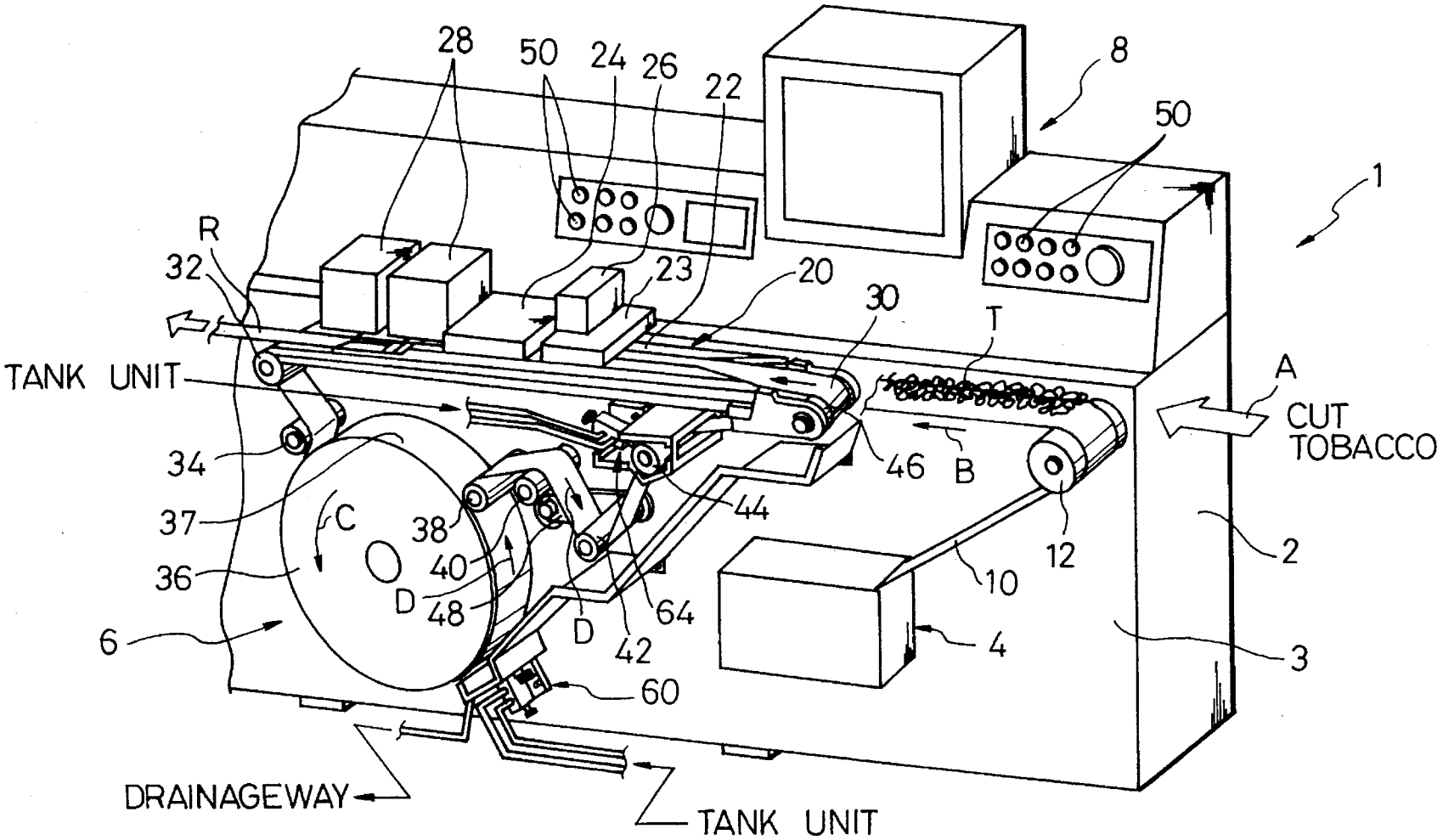
FIG. 1 is a perspective view showing a cigarette rod manufacturing apparatus.

A cigarette manufacturing apparatus 1 shown in FIG. 1 comprises a frame 2, paper feeding device 4, wrapping device 6, and main control device 8. The frame 2 includes a front cover (not shown) which partially covers the feeding device 4 and the wrapping device 6. In FIG. 1, the front cover is removed from the apparatus 1.

The paper feeding device 4 is provided on a front portion 3 of the frame 2. The feeding device 4 is loaded inside with a roll of paper 10, and the paper 10 with a uniform width (e.g., 27 mm) is delivered from the device 4. The paper 10 is fed past a feed roller 12 to the wrapping device 6, and extends horizontally after passing the roller 12. Cut tobacco T is supplied from a cut tobacco feeder (not shown), as indicated by arrow A, and delivered onto the paper 10. Thus, the paper 10 carries the cut tobacco T thereon as it advances in the direction indicated by arrow B.

The wrapping device 6 is also provided on the front portion 3 of the frame 2, and comprises a horizontal shaping section 20. The shaping section 20 includes a shaping tool 22 which is U-shaped over a predetermined range. As the paper 10 carrying the cut tobacco T thereon, along with a garniture tape 30 (mentioned later), passes by the tool 22, the paper 10 and the tape 30 are bent into the shape of a U by the tool 22.

The garniture tape 30 is an endless tape which passes horizontally through the shaping section 20. In the shaping section 20, the paper 10 is superposed on the garniture tape 30. The garniture tape 30 is a belt which has a uniform width (e.g., 21 mm) smaller than that of the paper 10, and is formed of an aramide fiber, for example. As the garniture tape 30 is run, the paper 10 is delivered from the paper feeding device 4 in a manner such that it is dragged by the tape 30 with a frictional force acting between them. Then, the paper 10 travels together with the garniture tape 30, and passes through the shaping tool 22.

That region of the garniture tape 30 which has passed the terminal end of the shaping section 20 threads along and between guide rollers 32 and 34, and is passed around a driving drum 36. The drum 36 is rotated by a motor (not shown) in the direction indicated by arrow C, whereby the garniture tape 30 travels in the fixed direction indicated by arrow D. That region of the garniture tape 30 which has passed the driving drum 36 is guided to the starting end of the shaping section 20 via guide rollers 38, 40, 42, 44 and 46.

The guide roller 42 is mounted on the front portion 3 of the frame 2 by means of a belt tensioner 48. Whether the guide roller 42 is situated in the position indicated by a full line in FIG. 2 or in the position indicated by a two-dot chain line (which will be mentioned later), therefore, the garniture tape 30 can be continually kept in a stretched state without looseness by the belt tensioner 48.

A short holder 23, along with a preshaping tool or shoe (not shown), is arranged over the shaping tool 22 of the shaping section 20. The holder 23 is situated on the downstream side of the shoe with respect to the traveling direction of the paper 10. When the paper 10, along with the garniture tape 30, passes the short holder 23, the holder 23 bends one side edge portion of the U-shaped paper 10 into an arcuate shape, whereupon the cut tobacco T on the paper 10 is covered by the one side edge portion of the paper 10 from above.

A paste applicator 26 is located over the short holder 23. The applicator 26 is used to apply paste to the other side edge of the U-shaped paper 10. The applicator 26 is provided with a paste wheel for transferring the paste to the other side edge of the paper 10 or a paste nozzle for spraying a liquid paste to the paper edge.

Further, a long holder 24 is located over the shaping tool 22 of the shaping section 20. The holder 24 is situated on the downstream side of the short holder 23 with respect to the traveling direction of the paper 10. As the paper 10, traveling together with the garniture tape 30 on the tool 22, passes the long holder 24, the holder 24 bends the other side edge portion of the paper 10 into an arcuate shape, whereupon the other side edge of the paper 10 is superposed on the arcuate one side edge, and the two edges are bonded together. In this manner, the cut tobacco T is fully wrapped in the paper 10, and a cigarette rod R is formed continuously.

Furthermore, two dryers 28 are arranged on the downstream side of the long holder 24. Each dryer 28 includes a heater which extends along a pasting region of the cigarette rod R. As the rod R advances through the dryers 28, therefore, its pasting region is dried, so that the adhesion between-the opposite side edges of the paper 10 is stabilized.

When the cigarette rod R is formed in this manner, it is delivered from the shaping section 20 to a cutting section through a checking section. In the cutting section, the cigarette rod R is cut into individual double cigarettes. Each double cigarette is twice as long as each cigarette as a final product. In the checking section, the diameter of the cigarette rod and the packing density of the cut tobacco T in the rod are examined.

The front portion 3 of the frame 2 is provided with a spray nozzle 60 which is situated under the driving drum 36. The tip end of the nozzle 60 is directed to that region of the garniture tape 30 which is passed around an outer peripheral surface 37 of the drum 36. The front portion 3 of the frame 2 is further provided with another spray nozzle 64 which resembles the spray nozzle 60 and is situated beside the guide roller 44.

Figure 2:
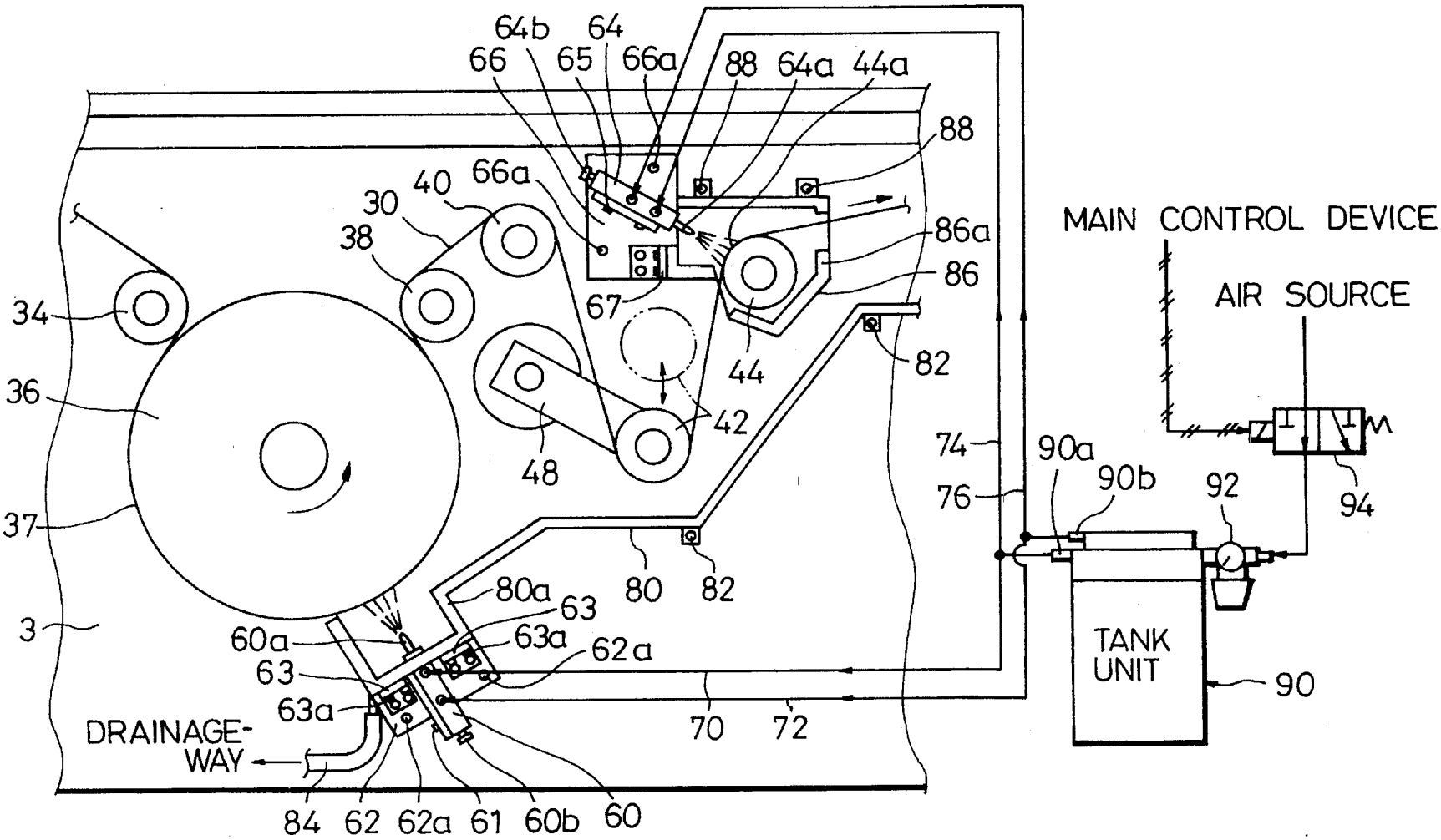
FIG. 2 is a front view showing part of the manufacturing apparatus of FIG. 1 in detail.

FIG. 2 is an enlarged view showing the spray nozzles 60 and 64 and their surroundings. Referring now to FIG. 2, the spray nozzles 60 and 64 will be described.

The spray nozzles 60 and 64 are atomizer-type nozzles which have a function to spray a wetting liquid (e.g., water) along with air through their nozzle tips. The wetting liquid is sucked up by utilizing a negative pressure which is produced as the air is discharged. Since the spray nozzles 60 and 64 are constructed in a generally-known manner, a detailed description of their construction is omitted herein.

A bracket 62 for the spray nozzle 60 is fixed on the front portion 3 of the frame 2 by means of bolts 62*a*, and the nozzle 60 is mounted on the bracket 62 by means of bolts 61.

More specifically, the nozzle 60 is attached to the bracket 62 in a manner such that its tip end 60*a* is directed at right angles to the outer peripheral surface 37 of the driving drum 36, and a predetermined space is secured between the tip end 60*a* and the surface 37.

An air hose 70 and a liquid hose 72 are connected to the spray nozzle 60. The liquid hose 72 extends toward a tank unit 90 which stores the wetting liquid therein. Thus, the nozzle 60 can receive the wetting liquid from the tank unit 90 through the liquid hose 72. On the other hand, the air hose 70 extends to a compressed air source (not shown) through the tank unit 90, and is connected to the air source.

The spray nozzle 60 can also receive compressed air from the air source through the air hose 70. When the compressed air supplied to the nozzle 60 through the air hose 70 is jetted from the nozzle tip end 60*a*, the wetting liquid in the tank unit 90 is sucked up into the nozzle 60 through the liquid hose 72 by means of the negative pressure in the nozzle 60. The sucked liquid is atomized in the compressed air and discharged from the nozzle tip end 60*a* to be sprayed on the garniture tape 30 on the outer peripheral surface 37 of the driving drum 36.

A needle valve 60*b* for adjusting the spray rate of the wetting liquid is provided on the rear end portion of the spray nozzle 60. The spray rate of the wetting liquid can be regulated by changing the opening of the valve 60*b*.

A rustproof cover 80 is attached to the bracket 62 for the spray nozzle 60 by means of brackets 63 and bolts 63*a*. The cover 80 prevents the wetting liquid sprayed from the spray nozzle 60 from scattering around the nozzle 60. Thus, the devices surrounding the nozzle 60 can be prevented from being rusted by the wetting liquid. More specifically, the rustproof cover 80 underlies the garniture tape 30 and extends from the driving drum 36 to the starting end of the shaping section 20. The cover 80 is fixed perpendicularly to the front portion 3 of the frame 2 by means of a plurality of bolts 82.

A flange 80*a*, which extends parallel to the front portion 3 of the frame 2, is formed on that side edge of the rustproof cover 80 which is situated farther from the front portion 3. The aforementioned front cover can engage the flange 80*a*.

A drain hose 84 is connected to the lower end portion of the rustproof cover 80. The hose 84 extends toward a drainageway (not shown) to be connected thereto. Thus, the wetting liquid which is received by the cover 80 and flows down along the surface of the cover 80 is discharged through the drain hose 84.

Moreover, a bracket 66 for the spray nozzle 64 is fixed on the front portion 3 of the frame 2 by means of bolts 66*a*, and the nozzle 64 is mounted on the bracket 66 by means of bolts 65. More specifically, the nozzle 64 is attached to the bracket 66 in a manner such that its tip end 64*a* is directed at right angles to an outer peripheral surface 44*a* of the guide roller 44, and a predetermined space is secured between the tip end 64*a* and the surface 44*a*.

An air hose 74 and a liquid hose 76, which extend toward the tank unit 90, are connected to the spray nozzle 64. The hoses 74 and 76 diverge from those regions of the air hose 70 and the liquid hose 72, respectively, which are situated between the spray nozzle 60 and the tank unit 90. Thus, the nozzle 64, like the nozzle 60, can spray the atomized wetting liquid on the garniture tape 30 on the outer peripheral surface 44*a* of the guide roller 44.

A needle valve 64*b* is provided on the rear end portion of the spray nozzle 64. The spray rate of the wetting liquid from the nozzle 64 can be regulated by changing the opening of the valve 64*b*.

A rustproof cover 86 is attached to the bracket 66 for the spray nozzle 64 by means of a bracket 67. The cover 86 surrounds the tip end 64*a* of the spray nozzle 64 and the guide roller 44 from below. The cover 86 is fixed perpendicularly to the front portion 3 of the frame 2 by means of bolts 88. A flange 86*a*, like the flange 80*a* of the rustproof cover 80, is formed on that side edge of the rustproof cover 86 which is situated farther from the front portion 3 of the frame 2.

A drain hole (not shown) is provided at the lower end portion of the rustproof cover 86. Thus, the wetting liquid which is received by the cover 86 and flows down along the surface of the cover 86 falls onto the rustproof cover 80 through the drain hole.

As mentioned before, the air and liquid hoses 74 and 76 are connected and joined to the air and liquid hoses 70 and 72, respectively. The hoses 70 and 72 are connected to the tank unit 90 by means of nipples 90*a* and 90*b*, respectively, on the top portion of the unit 90.

The nipple 90*a* is connected to one end of an internal passage (not shown) of the tank unit 90. The internal passage extends through the top portion of the unit 90, and a regulator valve 92 is connected to the other end of the internal passage. The valve 92 is connected to the aforesaid air source. Thus, the compressed air from the air source can be fed into the air hoses 70 and 74 via the regulator valve 92, internal passage, and nipple 90*a*. The pressure of the air fed into the air hoses 70 and 74 is adjusted by the regulator valve 92.

A solenoid valve 94 is interposed between the regulator valve 92 and the air source. The valve 94 is opened or closed in response to a driving signal from the main control device 8. Thus, the compressed air from the air source is supplied selectively to the side of the regulator valve 92.

The tank unit 90 has a reservoir therein. The nipple 90*b* is connected to one end of a tube (not shown) in the tank unit 90, and the other end of the tube is connected to the reservoir. Thus, the wetting liquid in the reservoir can be fed into the liquid hoses 72 and 76 through the tube and the nipple 90*b*.

The main control device 8 can control the operations of various parts of the manufacturing apparatus 1. An input interface of the device 8 is connected with various control buttons 50 on a control panel, a detecting device (not shown) for detecting the rotating speed of the driving drum 36, etc. On the other hand, an output interface of the device 8 is connected with the paste applicator 26, dryers 28, drive source of the driving drum 36, solenoid valve 94, etc. The main control device 8 controls the operations of output-side devices in accordance with signals from input-side devices.

The following is a description of the spraying operation of the spray nozzles 60 and 64 which cooperate with the solenoid valve 94.

When the garniture tape 30 is run at a high speed as the driving drum 36 is driven, part of the tape 30 which passes over the shaping section 20, that is, part of the tape 30 which is in sliding contact with the shaping tool 22 and the short and long holders 23 and 24, is subjected to frictional heat which is generated by the sliding contact. The frictional heat raises the temperature of the garniture tape 30, whereupon moisture in the tape 30 evaporates, so that the tape 30 is dried. If the water content of the garniture tape 30 is lowered, the tape 30 loses its pliability and becomes liable to deterioration, and its coefficient of friction is lowered. Accordingly, a slip is caused between the garniture tape 30 and the paper 10 or between the tape 30 and the driving drum 36, so that the travel of the paper 10 becomes unstable. According to the present invention, therefore, the wetting liquid is sprayed from the spray nozzles 60 and 64, thereby keeping the garniture tape 30 wet.

When the solenoid valve 94 is not supplied with any operating signal from the main control device 94, it cuts off the tank unit 90 from the air source. When an operating signal is delivered from the control device 8 to the solenoid valve 94, however, the valve 94 is switched in the manner shown in FIG. 2, so that the air source and the tank unit 90 are connected. Thereupon, the compressed air is supplied from the air source to the spray nozzles 60 and 64 via the regulator valve 92, internal passage of the tank unit 90, and air hoses 70 and 74, respectively. When the operation of the cigarette rod manufacturing apparatus 1 is started, or when the rotating speed V of the driving drum 36 is not lower than a predetermined value V1, the main control device 8 delivers an operating signal to the solenoid valve 94.

The compressed air supplied to the spray nozzles 60 and 64 causes the wetting liquid, sucked in through the liquid hoses 72 and 76 from the reservoir of the tank unit 90, to be atomized and jetted from the respective tip ends 60*a* and 64*a* of the nozzles 60 and 64. The atomized wetting liquid jetted from the tip end 60*a* of the spray nozzle 60 is sprayed on the outside of that region of the garniture tape 30 which is passed around the outer peripheral surface 37 of the driving drum 36, that is, that region of the tape 30 which passes by the spray nozzle 60, thereby wetting the specific region of the tape 30. Since the garniture tape 30 is formed of a fiber, the wetting liquid on the outer surface of the tape 30 permeates the fiber.

Since the garniture tape 30 is traveling at a high speed, the surplus wetting liquid having failed to be absorbed by the fiber of the wet portion of the tape 30 is flung about before the wet portion reaches the starting end of the shaping section 20. Thus, the surplus wetting liquid on the outer surface of the wet portion of the garniture tape 30 can be thoroughly removed before the wet portion comes into contact with the paper 10. Even though the paper 10 is superposed on the outer surface of the tape 30, thereafter, it can be prevented from being wetted by the wetting liquid and torn.

Further, the atomized wetting liquid jetted from the tip end 64*a* of the spray nozzle 64 is sprayed on the inner surface of the garniture tape 30 which is passed around the guide roller 44, that is, on the inner surface of that region of the tape 30 which passes by the nozzle 64. Thus, those regions of the garniture tape 30 which have passed by the spray nozzles 60 and 64 are infiltrated with the wetting liquid evenly and sufficiently.

The garniture tape 30 can be prevented from drying by being infiltrated with the wetting liquid sprayed from the spray nozzles 60 and 64 in this manner. Since the tape 30 in the shaping section 20 is subjected to the aforementioned frictional heat, the wetting liquid in the tape 30 partially evaporates. The evaporation of the wetting liquid absorbs heat from the tape 30, so that the temperature of the tape 30 can be checked from rising. Thus, the garniture tape 30 can be restrained from being deteriorated, its life is prolonged, and the frequency of its replacement is lowered.

Since the frictional forces between the garniture tape 30 and the paper 10 and between the tape 30 and the driving drum 36 can be maintained with stability, moreover, the paper 10 and the tape 30 can be prevented from slipping on the tape 30 and the drum 36, respectively.

In particular, the spray nozzle 64 sprays the wetting liquid on the inner surface of that region of the garniture tape 30 which is situated closer to the starting end of the shaping section 20 than in the case of the spray nozzle 60. Therefore, that region of the tape 30 which passes by the starting end of the shaping section 20 is infiltrated more with the wetting liquid on the inside than on the outside. Thus, when the inner surface of the garniture tape 30 is brought into sliding contact with the shaping tool 22 and the short and long holders 23 and 24 of the shaping section 20, production of frictional heat can be restrained satisfactorily by the improved lubrication, so that the tape surface cannot be overheated.

The garniture tape 30 can be also cooled by blowing the compressed air from the spray nozzles 60 and 64 for spraying the atomized wetting liquid against the tape 30.

If the wetting liquid sprayed on the garniture tape 30 is too much or too little, its spray rate can be properly adjusted by means of the respective needle valves 60*b* and 64*b* of the spray nozzles 60 and 64.

If the wetting liquid cannot be uniformly sprayed on the garniture tape 30 because the jet speed of the compressed air from the spray nozzles 60 and 64 is too high or too low, the pressure of the air to be supplied to the nozzles 60 and 64 is adjusted by means of the regulator valve 92. Thus, the wetting liquid can be satisfactorily sprayed on the garniture tape 30 without unevenness.

The atomized wetting liquid is scattered around the tip ends 60*a* and 64*a* of the spray nozzles 60 and 64, while the surplus wetting liquid remaining without being absorbed by the garniture tape 30 is flung about like a mist in the vicinity of the driving drum 37 and the guide roller 44. The misty wetting liquid is received by the rustproof covers 80 and 86. Thus, the wetting liquid can never splash on the paper feeding device 4 and the like that are located below the garniture tape 30. The wetting liquid received by the covers 80 and 86 flows down along the inside of the cover 80, and is discharged through the drain hose 84. The wetting liquid can be recycled by restoring the discharged liquid to the tank unit 90.

As described in detail herein, the temperature of that region of the garniture tape 30 which passes through the shaping section 20 is restrained from rising if the wetting liquid from the spray nozzles 60 and 64 is sprayed on the tape 30. Accordingly, the pliability of the tape 30 can be maintained for a long period of time. Thus, the tape 30 is not liable to deterioration, and its life is prolonged. In consequence, the frequency of replacement of the garniture tape 30 is lowered, so that the operating efficiency of the cigarette rod manufacturing apparatus 1 is improved, and the running cost of the apparatus is reduced.

Also, slipping of the paper 10 or the garniture tape 30 itself, which is attributable to the dry state of the tape 30, is prevented. Accordingly, the travel of the garniture tape 30 is stabilized for a long period of time. Thus, the packing of the cut tobacco T in the manufactured cigarette rod R can be stabilized, so that a good quality cigarette rod R or double cigarettes can be maintained.

In the embodiment described above, the spray nozzles 60 and 64 are located close to the driving drum 36 and the guide roller 44, respectively. However, the nozzles 60 and 64 can be located in any other desired positions provided that they are situated in the vicinity of the path of travel of the garniture tape 30 which extends outside the shaping section 20. Preferably, in this case, the spray nozzle 60 for spraying the wetting liquid on the outer surface of the garniture tape 30 is located on the terminal end side of the shaping section 20. Thus, the paper 10 can be prevented from being wetted by the wetting liquid. Preferably, moreover, the spray nozzle 64 for spraying the wetting liquid on the inner surface of the garniture tape 30 is located on the starting end side of the shaping section 20. Thus, the production of the frictional heat, which is attributable to the sliding contact between the garniture tape 30 and the shaping tool 22 and short and long holders 23 and 24 of the shaping section 20, can be restrained by the wetting liquid sprayed on the inner surface of the tape 30. In this manner, the temperature of the garniture tape 30 can be satisfactorily checked from rising.

The embodiment described above utilizes two spray nozzles 60 and 64. Alternatively, however, the apparatus may be provided with only one spray nozzle or three or more spray nozzles.

According to the aforementioned embodiment, moreover, the spray rate of the wetting liquid from the spray nozzles 60 and 64 is manually adjusted by means of the needle valves 60*b* and 64*b*. Alternatively, however, the main control device 8 may be connected with actuators for individually actuating the valves 60*b* and 64*b* and non-contact sensors for detecting the temperature or water content of the garniture tape 30. In this case, the control device 8 can control the respective operations of the actuators for the needle valves 60*b* and 64*b* in accordance with detection signals from the non-contact sensors, traveling speed of the garniture tape 30, etc. Thus, the spray rate of the wetting liquid can be adjusted automatically. Preferably, the respective operations of the needle valves 60*b* and 64*b* are controlled independently of each other, whereby the spray rates for the spray nozzles 60 and 64 are regulated independently and automatically. Further, the operations of the actuators may be controlled by means of control buttons on the aforementioned control panel.

Preferably, furthermore, the adjustment of the air pressure by means of the regulator valve 92 is also controlled automatically. In this case, the valve 92 is provided with an actuator therefor, and the operation of this actuator is controlled by the main control device 8 in accordance with detection signals from the non-contact sensors, traveling speed of the garniture tape 30, etc. In doing this, the automatic adjustment of the air pressure is optimally controlled in consideration-of the automatic adjustment of the spray rate of the wetting liquid. Preferably, moreover, the actuator for the regulator is designed so that its operation can be adjusted by means of a control button on the control panel.

According to the embodiment described herein, furthermore, the wetting liquid is sprayed on the garniture tape 30 by means of the spray nozzles 60 and 64. Alternatively, however, a humidifier may be used in place of the spray nozzles. In this case, the humidifier has a booth which is kept highly humid inside, and the garniture tape 30 extends through the booth.

What is claimed is:

1. A cigarette rod manufacturing apparatus comprising:

a shaping section for continuously forming a cigarette rod in a manner such that cut tobacco fed onto paper is wrapped in the paper as the paper travels, the shaping section including an endless garniture tape for running the paper and a shaping tool for forming the paper and the cut tobacco into the cigarette rod in cooperation with the garniture tape, the shaping tool having an inlet and an outlet for the garniture tape; and humidifying means for humidifying the garniture tape.

2. The apparatus according to claim 1, wherein the garniture tape is formed of a fibrous material having hygroscopicity.

3. The apparatus according to claim 2, wherein the humidifying means includes a spray device for atomizing a wetting liquid and spraying the atomized liquid on the garniture tape.

4. The apparatus according to claim 3, wherein the spray device jets air to atomize the wetting liquid.

5. The apparatus according to claim 4, wherein the humidifying means further includes adjusting means for adjusting the spray rate of the wetting liquid from the spray device.

6. The apparatus according to claim 3, wherein the spray device is located outside the shaping section.

7. The apparatus according to claim 6, wherein the humidifying means includes first and second spray devices located individually in the vicinity of the path of travel of the garniture tape and spaced.

8. The apparatus according to claim 7, wherein the first and second spray devices are located on the outlet and inlet sides, respectively, of the shaping tool of the shaping section.

9. The apparatus according to claim 8, wherein the first spray device sprays the atomized wetting liquid on the outer surface of the garniture tape to be brought into contact with the paper, and said second spray device sprays the atomized wetting liquid on the inner surface of the garniture tape.

10. The apparatus according to claim 9, wherein the humidifying means further includes means for recovering that part of the wetting liquid from the first and second spray devices which is not absorbed by the garniture tape.

* * * * *